United States Patent [19]

Ast et al.

[11] Patent Number: 4,783,666

[45] Date of Patent: Nov. 8, 1988

[54] PROTECTIVE SHIELD FOR AN ANTENNA ARRAY

[75] Inventors: Harry C. Ast, Camillus; John D. Reale, Syracuse, both of N.Y.

[73] Assignee: General Electric Company, Syracuse, N.Y.

[21] Appl. No.: 52,728

[22] Filed: May 21, 1987

[51] Int. Cl.[4] ..... H01Q 1/42

[52] U.S. Cl. ..... 343/872; 343/873

[58] Field of Search ..... 343/872, 873

*Primary Examiner*—William L. Sikes
*Assistant Examiner*—Robert E. Wise
*Attorney, Agent, or Firm*—Richard V. Lang; Carl W. Baker; Fred Jacob

[57] ABSTRACT

A protective shield for an electrically steered, high performance C Band antenna array is disclosed. The shield is of a multi-layer construction in which a sandwich is formed between two fiberglass layers and a central foam core to minimize electrical reflections; and in which an additional foam layer is provided for structural support and to minimize changes in mutual coupling, installed between the sandwich and planarly disposed dipoles of the array. In addition, a teflon layer is applied to the outer layer of the sandwich and coated with fumed $SiO_2$. The hydrophobic properties of the teflon-fumed $SiO_2$ combination minimizes the effects of rain on antenna performance.

6 Claims, 2 Drawing Sheets

PROTECTIVE SHIELD FOR AN ANTENNA ARRAY

BACKGROUND OF THE INVENTION

The invention relates to antenna arrays, and more particularly to shield for protecting an array from the effects of weather with a minimum effect upon array performance in good weather or bad.

DESCRIPTION OF THE PRIOR ART

It is a common practice to install radar antennas within a "Radome", a structure designed to protect the antenna from the weather while not adversely affecting its electrical performance.

Such structures have been described in the MIT Radiation Laboratory Series, Volume 12 entitled "Microwave Antenna Theory and Design" (1945). The subject of "Radomes" is treated in Chapter XIV entitled "Antenna Installation Problems".

A common prior design is an "Igloo" shaped structure. Since the structure conventionally houses a rotating array, with azimuthal and vertical rotations, a hemispherical housing which also presents minimum wind resistance is indicated. The wall sections of such radomes were designed to provide minimum dissipative loss and minimum reflective loss. Wall sections of a single layer as well as sandwich constructions are known. In a sandwich construction, a relatively strong high dielectric constant material surrounds a low density low dielectric core.

Since the clearances between the antenna and the radome were relatively large in relation to the spacing between individual elements of the antenna, the radome did not affect the mutual coupling between antenna elements. Prior mechanically rotated arrays operated at relatively long wavelengths, and were of correspondingly large dimensions.

Currently, electronic steering, higher frequencies, and mobility has dictated a more compact panel shaped antenna enclosure. In an electronically steered antenna, operating at mid C-Band, several thousand antenna elements may be employed in an 8 to 10 foot aperture, each subject to beam forming and beam steering control. In such an antenna the protective enclosure is ideally flat—a "shield"—and it should be placed in close proximity to the antenna elements to reduce the bulk of the radar equipment.

As with the prior antenna systems, the radiating elements of an electronically steered array, operating above 1 gigaHertz, must also be protected from mechanical abuse and from exposure to the weather. The protective shield should not reduce array performance in good weather over a device without a shield and should improve array performance in bad weather over an unoptimized design.

Granted that a protective shield is to be applied over the array, it should retain a transparent quality. It should absorb negligible amounts of power. Although closely spaced from the antenna elements, the shield's presence or absence should not affect performance of the array. Both the beam pointing accuracy and the side lobe levels should remain relatively unchanged. In addition, under inclement weather conditions, the shield should minimize the adverse affects caused by water forming on the shield during rain.

SUMMARY OF THE INVENTION

Accordingly, it is an object of the invention to provide an improved weather protective shield for an array antenna.

It is another object of the invention to provide an improved weather protective shield for an array antenna operably above 1 gHz.

It is still another object of the invention to provide a weather protective shield for an array antenna which has a minimum effect upon antenna performance.

It is another object of the invention to provide a weather protective shield for an array antenna which is of optimum performance in rain and which adds minimum bulk to the antenna installation.

These and other objects of the invention are achieved in a novel removable, weather protective shield for an antenna array. The shield has a minimum effect upon the radiation pattern and active impedance of the array, and provides minimum adverse affect upon the array during rain.

The shield has a modified multi-layer sandwich configuration. It has a first thin layer of a fiberglass reinforced construction, teflon filled on its outer surface to reduce wetting or surface contamination, bonded to the outer surface of a second layer of a fiberglass reinforced resin filled construction. A third, thick layer of a low density foam construction, having a low dielectric constant, forms the core element of the sandwich and a fourth, thin layer of a fiberglass reinforced resin filled construction is bonded to the core. A fifth layer of low density foam construction is bonded to the fourth layer, and is in substantial contact with the dipole elements when the shield is in position to provide distributed support to the shield.

In accordance with the invention, the fifth layer is of adequate thickness to avoid significantly affecting the mutual coupling between dipole elements so that the radiation patterns and active impedances of the array are substantially unaffected by the presence or absence of said shield. The layers of the shield have thicknesses selected to minimize losses occasioned by reflections during transmission and/or reception of r.f. signals at specified frequency bands.

For these purposes, the third, foam layer has a thickness of approximately an odd quarter electrical wavelength in the foam for optimum cancellation of reflections and the fifth layer has a thickness substantially equal to or exceeding one-quarter electrical wavelength at the frequency band of operation to avoid affecting the mutual coupling between elements of the array.

For mechanical strength, the third layer is rigid foam to preserve the separation between the fiberglass layers, and the fifth layer is a flexible foam which, when compressed, provides distributed support and additional stiffness to said shield.

A coating of hydrophobic fumed $SiO_2$ is applied to the teflon filled surface to reduce the adverse effects of rain upon antenna performance.

BRIEF DESCRIPTION OF THE DRAWINGS

The novel and distinctive features of the invention are set forth in the claims of the present application. The invention itself, however, together with further objects and advantages thereof may best be understood by reference to the following description and accompanying drawings in which:

DESCRIPTION OF THE PREFERRED EMBODIMENT

A novel protective shield for an antenna array is illustrated in FIGS. 1–4. The shield is shown at 10 in an exploded view in which the shield is displaced to the right of the radar equipment cabinet 11. The front face of the equipment cabinet provides a ground plane 12 for the antenna array 13 and a mechanical support for the shield. The ground plane 12 is planar having a plurality of dipole elements which form the antenna array and project through the ground plane 12. The shield 10, when in place upon the cabinet, is attached about the perimeter to the ground plane 12, and the shield is recessed to accommodate the projecting dipole elements.

Figure 5:
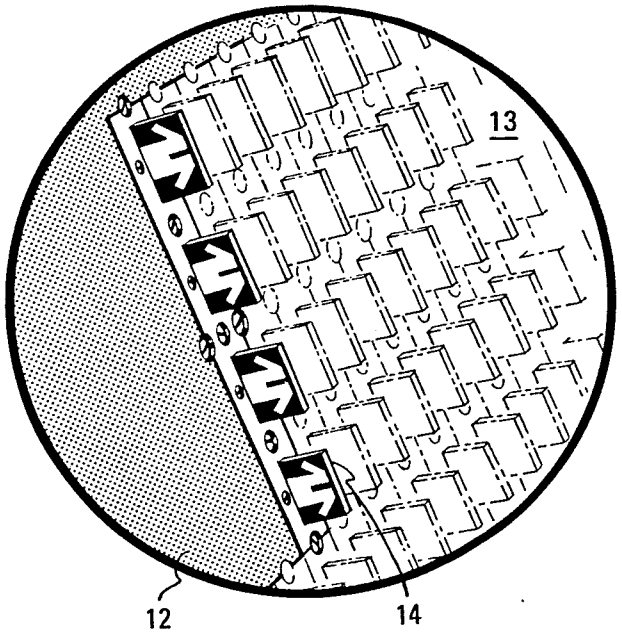
FIG. 5 is a larger scale view of the individual dipole elements projecting through the ground plane structure of the steered array.
Figure 1:
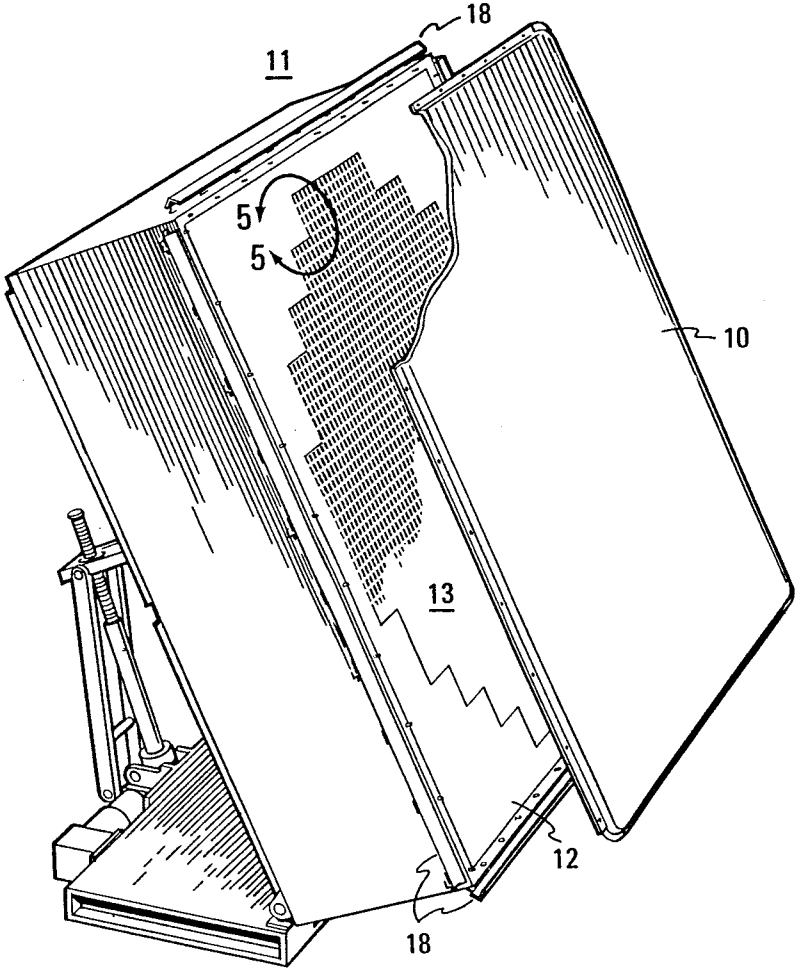
FIG. 1 is an exploded view of a steered array including a novel protective shield adapted to be installed over the steered array.

The array, which is pictured in FIG. 1, is designed to be of high performance. Typically the array includes somewhat less than 3,000 individual dipole elements arranged in the general manner illustrated in FIG. 1 over a 70 square foot surface (in a C-Band application. The array is designed to be electrically steered and to have a beam pattern of maximum resolution consistent with the aperture dimensions. In the C-Band application, the shield design will not affect antenna performance even with greatly reduced side lobes.

The protective shield, whose mechanical design details are illustrated in FIGS. 1–4 has been found to provide nearly ideal performance for the array illustrated in FIG. 1. More particularly, the radiation loss associated with the presence of the antenna is less than 0.20 decibel, the effects on beam steering are less than several hundredths of a degree, The effect on sidelobes is minimal, and water wedging during rainfall is generally eliminated by applicant's shield.

Water wedges are formed when wetted surfaces are tilted and a direction for run off is established. The "wedge" is explained as due to the dynamics of the wetting and run off process. The rain drops are assumed to impinge on a surface in equal numbers per unit area on the average. The water so accumulated is confined under a continuous sheet which forms on a wetted surface. When the surface is tilted, the confined water moves downward, primarily under the influence of gravity, to the bottom where it drops off the surface. In steady flow, upstream there is little area for rain accumulation, the rate of flow is smaller and the thickness of the water under the sheet less. As one proceeds downstream, the area for rain accumulation increases, the rate of flow increases, and the thickness of the water under the sheet increases. Thus a water wedge is formed on a tilted wetted surface, thin at the top and thick at the bottom. (In the case of strong winds, the wedging can have a horizontal component as well as a vertical component.)

Water wedging can affect the operation of the array in several ways. The sheet of water formed from rain is both absorbent and reflective of r.f. energy, and thus affects attenuation, pointing accuracy, steering and the side lobe levels. The effect of water wedges is to cause several decibels of attenuation and errors of several tenths of a degree in pointing accuracy and several decibels increase in side lobes.

In the present embodiment, the formation of an adherent sheet of water and the formation of water wedges is usually prevented. The effects following rain showers are of negligible duration since there is no dry out period.

Figure 2A:
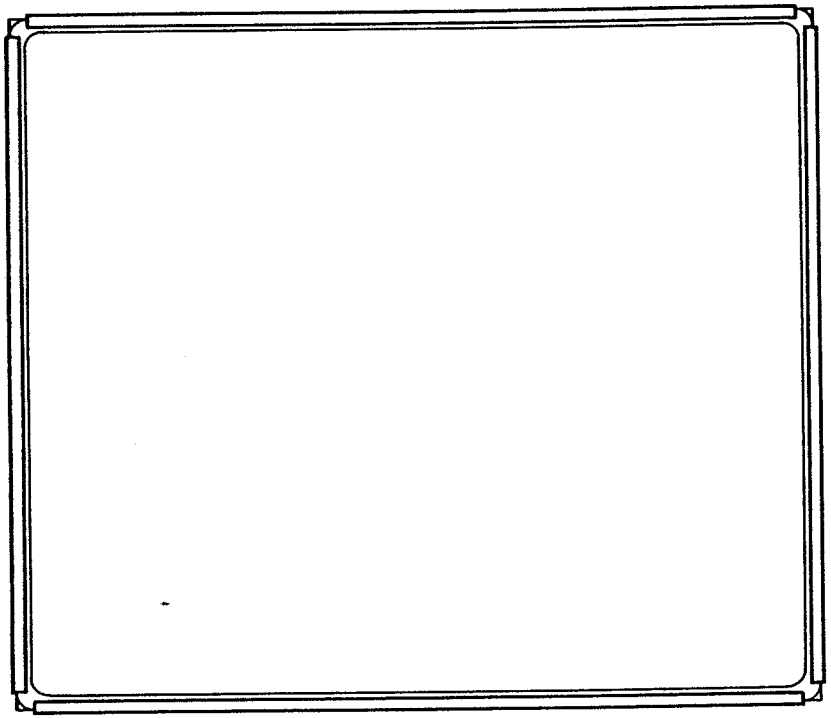
FIGS. 2A and 2B are respectively plane and edge views of the protective shield of FIG. 1.

Turning now to FIG. 2A, a plan view of the protective shield is illustrated. The shield has a rectangular outline and is of a planar configuration.

Figure 4:
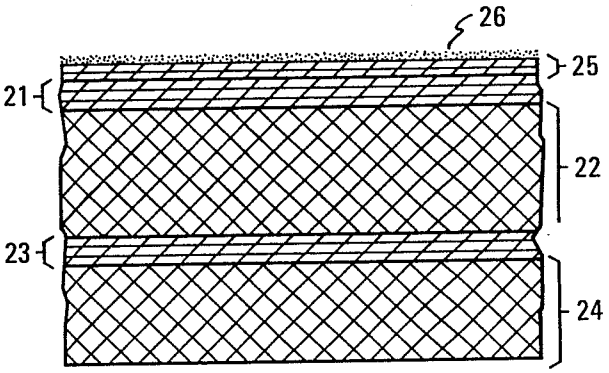
FIG. 4 is a view of the cross-section of the protective shield at a position over the radiating elements.

FIG. 4 shows the cross section of the elevated face of the shield, typical of the region disposed over the dipole elements. The elevated face is a multi-layered structure. The layers 21 and 23 are fiberglass reinforced resin filled sheets 0.014 inches thick. The layer 22 is a closed cell, rigid, foamed resinous layer having a thickness of 0.640 inches disposed between the two fiberglass reinforced sheets. The layer 25, is a 0.009 inch thick fiberglass reinforced, resin filled sheet with teflon impregnated on its upper surface. A polyester resin is a suitable resin for filling the fiberglass sheets of layers 21, 23 and the under surface of 25. A suitable material for the rigid foamed layer 22 is a polyvinyl chloride polymer.

A closed cell, flexible, foamed resinous layer 24 is attached to the under surface of the fiberglass 23. This layer 24 has a density of approximately 2.5 pounds per cubic foot and is 0.500 inches thick. A suitable material for layer 24 is a cross linked low density polyethylene polymer. When the shield is in position on the ground plane 12, the inner layer 24 of the shield is compressed against the outer surfaces of the dipole elements, adding substantial distributed support to the shield throughout the array.

Layer 25 is attached to the outer surface of the sheet 21 to enhance the rain shedding quality of the shield. Teflon impregnation is selected for the upper surface of layer 25 because of the wear resistance and the water shedding quality which teflon imparts to the shield. A final layer 26 is a hydrophobic coating, nominally 0.002 inches thick. It consisting of a tacky primer coat by means of which fumed silicon dioxide ($Sio_2$) particles on the order of 0.5 to one micron in size are adhered upon the teflon impregnated surface of layer 21.

The shield just described has been found to provide the required protective functions over a reasonable life span without degradation of the electrical performance of the array.

The r.f. transparency of the shield, while retaining the necessary mechanical strength, is primarily attributable to the use of strong sheet materials with appropriately small thicknesses, spaced aprt by an appropriate thickness by a low dielectric constant rigid foam in a sandwich construction. A wave incident on the radome and impinging on the fiberglass referenced layers 21-25 is partially reflected and partially transmitted. The partially transmitted portion of the arriving wave continues through the foam core 22 and upon impinging on the fiberglass reinforced layer 23, that portion is again partially reflected and partially transmitted. With an appropriate choice of thickness for the foam core, the portion reflected backward from the layers 21-25, and the portion reflected backward from the layer 23 arrive at layer 21-25, and continue thereafter 180° out of phase and in a relationship of mutual cancellation. Thus by correct selection of the design of the sandwich a substantial portion of the reflection from the fiberglass layers 21-25 and 23 is cancelled and transmission through the radome is enhanced.

The r.f. design for the foregoing shield is also strongly affected by the use of a flexible polyethylene foam layer 24, disposed between the fiberglass filled sheet 23 and the upper edges of the dipole substrates. The provision of distributed support permits one to minimize the thickness of the fiberglass reinforced layers and reduce the amount of reflected energy. The flexible foam is chosen to have a minimum density and a minimum dielectric constant in order to reduce the effect upon RF propagation and upon mutual coupling between the dipole elements. The foam has the further purpose of supportively displacing the nearest inner fiberglass layer 23 of the shield to an adequate distance from the dipole elements to cause negligible interference upon the mutual coupling between dipole elements. This precaution minimizes the effect of the radome shield upon array performance. The foam is 0.5 inches in thickness. The spacing is wavelength dependent, and while a matter of design tolerance, from the electrical performance viewpoint, should be on the order of a quarter wavelength and probably more.

The electrical parameters of the five layers making up the shield in a practical, computer optimized design for the mid C-Band frequency range are as follows:

| | Thickness | Dielectric Constant | Loss Tangent |
|---|---|---|---|
| Layer 25 | 0.009" | 3.00 | 0.005 |
| 21 | 0.014" | 4.30 | 0.016 |
| 22 | 0.640" | 1.07 | 0.002 |
| 23 | 0.014 | 4.30 | 0.016 |
| 24 | 0.500 | 1.04 | 0.0003 |

A computer analysis of the loss performance of the shield has been performed in which the losses for a perpendicular polarization (the E field perpendicular to the plane of an incident and the associated reflected ray) and for a horizontal polarization (the E field in the plane of an incident and the associated reflected ray) are separately calculated. The loss performance was calculated at specified frequencies in mid C-Band frequency range, and over angular beam deflections of from 0° to 45°. In the optimization corresponding to the selected parameters, the loss was minimized at the lower end of the band at about 0.05 db, with the greatest loss of about 0.08 db occurring at the upper end of the band. The losses for perpendicular versus parallel polarizations were nearly equal, both being within about 0.02 db of each other at the same frequency and steering angle. In the same optimization, greater losses occur at a zero steering angle and lesser losses occur at the maximum steering angles. At the lower portion of the band, the loss difference between 0° and 45° steering angles were about 0.01 db while at the upper end of the band they were about 0.04 db.

The computer analysis of the loss performance of the shield is highly accurate, and requires entry of the listed properties of each of the five layers. The computation of loss performance is in a sense exact in that it entails an assumption that each of the five layers has two surfaces at which a reflection may occur, and comprises both reflective and dissipative losses.

While the computer program entails an "exact solution", several design considerations should be stressed. The electrical loss performance of the five layer configuration can be approximated with an error of ±10% by a three piece sandwich, consisting of two thin dense layers, spaced apart an odd quarter wavelength.

The spacing ($S_0$) for the selected frequency is approximated as follows:

$$S_o = (2n + 1)\frac{\lambda_o}{4} - d\sqrt{\epsilon}$$

where n=0, 1, 2, 3 etc.

$\lambda_o$=the wavelength of the selected frequency in vacuo d=the thickness of the dense layers $\epsilon$=the relative dielectric constant of the dense layers.

The reflective coefficient for a wall of the general 3 layer sandwich configuration may be calculated from the electrical thicknesses of the fiberglass reinforced "skins" and the foam core and the relative dielectric constants of both.

The equations and measurements show that the electrical losses at the selected frequency are reduced as the rigid foam layer 23 of the hypothetical sandwich and the flexible foam layer 24 have reduced dielectric constants and reduced loss tangents. In addition, thinning the fiberglass layers 21-25 and 23 improves the electrical performance of the shield.

In the optimized design, which entails reliance on the distributed support provided by the flexible layer 24, it was found that the mechanical stiffness of the shield was adequate with a reduction in the thickness of the layers 21 and 23 by a factor of 2. As a consequence, the electrical loss performance was improved over the conventional radome design by a factor of 3.

Figure 3:
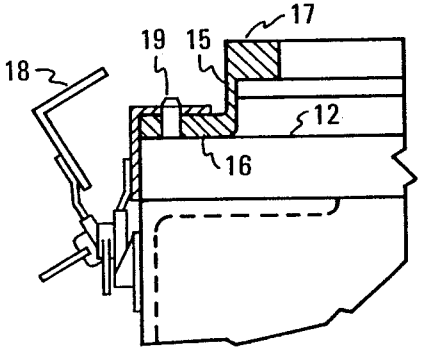
FIG. 3 is a cross-section view illustrating the mechanical details for attaching the protective shield to the ground plane structure of the steered array.
Figure 2B:
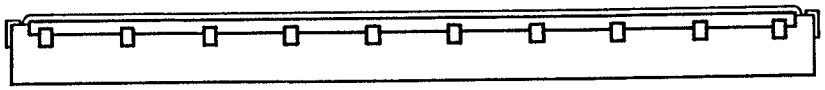

Further details of construction of the shield are best illustrated in FIGS. 2 and 3. The five layer sandwich of the shield is supported in substantially immobilizing engagement with the outer surfaces of the dipole elements means of by three structural members 15, 16 and 17. The member 15 is a rim provided around the perimeter of the shield having the depth required to accommodate the projecting dipole elements. The rim 15 transitions to an integral picture frame member 17 continuing around the perimeter of the five layer sandwich and providing direct support to the sandwich. The rim also transitions to an integral flange 16 by means of which the rim, and thereby the shield is supported upon the face of the equipment cabinet. The three members 15, 16 and 17 are substantial structural members.

The rim 15, flange 16, and frame 17 provide structural integrity for the shield when unmounted and stressed engagement of the shield with the antenna elements when mounted.

In the mounted position, the flange 16 is held in place by four hinged members 18 mounted on the walls of the cabinet. The hinged members 18 each include a compression hinged aluminum angle which snaps into place over the flange, and which presses the flange into engagement with the ground plane. Pins 19, spaced around the perimeter of the equipment face, mate with corresponding holes in the flange to ensure accurate alignment of the shield upon the equipment face. The pins also resist tensile stresses occasioned when the shield is at a lower temperature than the cabinet enclosure.

The flange dimensions are adjusted to cause a small (typically 0.050") compression of the flexible foam layer 24 about the perimeter of the shield. The compression diminishes toward the center of the array and is accompanied by an outward deflection of about 0.025 inches at the center of the shield. To prevent significant deflection of the inner fiberglass layer when the foam core 24 is under compression and thus altering the spacing between fiberglass layers 21-25 on the one hand and fiberglass layer 23 on the other hand, the foam core 22 is of a "rigid" foam as noted earlier. The foam core 22 is also of greater density and thereby has a greater resistance to compression. Both layers 23 and 24, using available foam materials, have values for the relative dielectric constant near unity, the former being about 1.09 and the latter about 1.04. Materials with low loss tangents are available and are employed.

The effect of the mounting structure is to immobilize the surfaces of the shield in relation to the dipole elements of the array under wide variations of wind and temperature. The support of the perimeter of the shield which compresses the layer 24 reduces vibratory or static displacements of the shield in relation to the shield under wind loading. In the practical design, displacements of the center of the shield under the influence of direct wind pressure over a range of velocities from 0 to 75 mph produced differential deflections at the center of the shield of less than 0.025 inches. In a temperature range of from −22° F. to +122° F. ambient (in the sun), deflections of less than 0.025 inches (with fiberglass layers having a temperature coefficient of expansion of $8\times10^{-6}$ in/in per degree F.) are achieved. Ranges of displacement of this magnitude do not to affect the electrical performance of the antenna array. The members 15, 16, and 17 also provide a continuous water tight and dust free joint between the shield and the equipment cabinet.

While the electrical design of the shield may be scaled in relation to frequency, the bulk of the shield tends to limit its application to frequencies above one gigaHertz. At frequencies above ten gigaHertz, the thickness of the foam layer 22 may be odd multiples higher than unity, of a quarter wavelength. The foam layer 24, may exceed the minimum electrical dimensions herein suggested, without significant loss of electrical efficiency. The thickness and strength of the foam layers must be adjusted in relation to the overall dimensions of the shield to achieve the desired rigidity or freedom from deflection. The shield thickness dimensions herein provided are appropriate to an eight foot aperture, and the foam thicknesses are optimized for operation over the mid C-Band range.

What is claimed is:

1. A protective shield for an array consisting of a plurality of like dipole elements projecting from a ground plane, said shield having a minimum effect upon the radiation pattern and active impedance of the array, and comprising:

(A) a first layer of a fiberglass reinforced material, teflon filled on one surface to reduce wetting or surface contamination, and resin filled on the other surface, bonded to one surface of a second layer;

(B) a second layer of a fiberglass reinforced resin filled material;

(C) a third layer of foam material having one surface bonded to the other surface of said second layer;

(D) a fourth layer of a fiberglass reinforced resin filled material having one surface bonded to the other surface of said third layer, and (E) a fifth layer of foam material having one surface bonded to the other surface of said fourth layer, and in substantial contact with said dipole elements when said shield is in position to provide distributed support to said shield, said fifth layer having a thickness that displaces said fourth layer from said dipole elements by the distance that minimizes the mutual coupling between dipole elements by the distance that minimizes the mutual coupling between dipole elements to reduce the affect of the presence or absence of said shield upon the radiation patterns and active impedances of the array.

said first, second and fourth layers being thin relative to said third and fifth layers, said layers having thicknesses selected to minimize reflective loss at specified frequency bands.

2. A protective shield as set forth in claim 1 for use at frequencies above a gigaHertz, wherein said third, foam layer has a thickness of approximately an odd multiple of a quarter electrical wavelength in said foam for optimum cancellation of reflections caused by the fiberglass reinforced layers on said one side of said third layer with reflections caused by the fiberglass reinforced layer on said other side of said foam layer and said fifth foam layer has a thickness substantially equal to at least one-quarter electrical wavelength at the frequency band of operation to avoid affecting said mutual coupling.

3. A protective shield as set forth in claim 2 wherein said third layer is a rigid foam to preserve the separation between the fiberglass layer bonded to respective surfaces thereof to stiffen the multi-layered shield structure;

said ground plane is a structural member supporting said projecting dipole elements, and said fifth layer is a flexible foam, which when compressed between said fourth layer and said dipole elements provides distributed support to said multilayer structure and additional stiffness across said shield.

4. A protective shield as set forth in claim 3 wherein said shield is provided with a structural support about the perimeter of said shield, by means of which said shield is attached to said ground plane in resilient engagement with said dipole elements, said support reducing static and dynamic displacements of said shield in relation to said ground plane attributable to variations in temperature and wind velocity.

5. A protective shield as set forth in claim 4 for use at mid C-Band frequencies wherein second and fourth layers are approximately 0.14" in thickness said third layer is approximately 0.64" in thickness having a dielectric constant of approximately 1.09 and said fifth layer is approximately 0.5" in thickness and has a dielectric of about 1.05.

6. A protective shield as set forth in claim 1, wherein a coating of hydrophobic fumed $SiO_2$ is applied to the outer filled surface of said first layer to reduce the water wedge effect of rain upon the radiation pattern.

* * * * *